US011167948B2

(12) United States Patent
Littlejohns et al.

(10) Patent No.: US 11,167,948 B2
(45) Date of Patent: Nov. 9, 2021

(54) WATERPROOF DISPENSING APPARATUS FOR ROLLING PAPER

(71) Applicant: Jacob Thomas Littlejohns, Canterbury, NH (US)

(72) Inventors: Jacob Thomas Littlejohns, Canterbury, NH (US); Andrew J. Clement, Farmington, NH (US)

(73) Assignee: Jacob Thomas Littlejohns, Canterbury, NH (US)

( * ) Notice: Subject to any disclaimer, the term of this patent is extended or adjusted under 35 U.S.C. 154(b) by 676 days.

(21) Appl. No.: 15/215,948

(22) Filed: Jul. 21, 2016

(65) Prior Publication Data

US 2017/0022023 A1 Jan. 26, 2017

Related U.S. Application Data

(60) Provisional application No. 62/195,362, filed on Jul. 22, 2015.

(51) Int. Cl.
*B65H 35/00* (2006.01)
*A24F 17/00* (2006.01)
(Continued)

(52) U.S. Cl.
CPC ..... *B65H 35/002* (2013.01); *A24F 17/00* (2013.01); *A24F 23/00* (2013.01); *B26F 3/02* (2013.01); *B65H 2405/45* (2013.01)

(58) Field of Classification Search
CPC ..... A24F 17/00; A24C 5/002; A24D 1/022; B65H 35/0006; B65H 35/002;
(Continued)

(56) References Cited

U.S. PATENT DOCUMENTS 4,369,929 A * 1/1983 Gayer ..... B65H 35/0006 206/225
4,467,974 A * 8/1984 Crim ..... A47K 10/3809 242/419.4
(Continued)

FOREIGN PATENT DOCUMENTS

GB 1396951 A * 6/1975 ..... A47K 10/16
GB 2391854 A * 2/2004 ..... B65H 35/002
WO WO-0111995 A1 * 2/2001 ..... A24F 17/00

*Primary Examiner* — Michael J Felton
*Assistant Examiner* — Sonny V Nguyen
(74) *Attorney, Agent, or Firm* — Jay S. Franklin

(57) ABSTRACT

A waterproof rolling paper dispensing apparatus which comprises an inner cylinder which is closed at one end and open at an opposite end thereof. The inner cylinder has an elongate slit and supports a cutting edge which facilitates cutting of a length of rolling paper from a continuous roll of rolling paper accommodated within the inner cylinder. An exterior housing is dosed at one end and open at an opposite end thereof. The exterior housing defines an internal storage compartment which stores the inner cylinder. An end cover releasably engages with the open end of the exterior housing and forms a waterproof seal therewith. The end cover also releasably engages with the open end of the inner cylinder so that when the end cover is removed from engagement with the exterior housing, the inner cylinder remains coupled to the end cover and is removed with the end cover.

20 Claims, 12 Drawing Sheets

(51) Int. Cl.
*B26F 3/02* (2006.01)
*A24F 23/00* (2006.01)

(58) Field of Classification Search
CPC ..... A47K 10/16; A47K 10/18; A47K 10/22; A47K 10/24; A47K 10/28; A47K 10/32; A47K 10/34; A47K 10/38; A47K 10/40
See application file for complete search history.

(56) References Cited

U.S. PATENT DOCUMENTS 4,538,751 A * 9/1985 Peterson ..... A24F 15/12 215/227
4,936,452 A * 6/1990 Pauley ..... A47K 10/3827 206/408
6,092,757 A * 7/2000 Leytem ..... B65H 35/0006 206/409
6,321,757 B1 * 11/2001 McCutcheon ..... A24F 15/18 131/231
2002/0175173 A1 * 11/2002 Diesterbeck ..... B65D 21/0219 220/782
2004/0251265 A1 * 12/2004 FitzSimons ..... A47K 10/38 221/92
2005/0236282 A1 * 10/2005 Huska ..... A24F 13/18 206/246
2007/0137454 A1 * 6/2007 DesRosiers ..... B26D 1/045 83/614
2010/0136494 A1 * 6/2010 Connolly ..... F23Q 2/32 431/253
2012/0223178 A1 * 9/2012 Riggs ..... B65D 75/5883 242/570
2013/0126577 A1 * 5/2013 De Rossi ..... B65H 35/002 225/7
2013/0221146 A1 * 8/2013 Cooper ..... B65H 16/005 242/160.4

* cited by examiner

WATERPROOF DISPENSING APPARATUS FOR ROLLING PAPER

CROSS REFERENCE TO RELATED APPLICATIONS/PRIORITY

This application claims the benefit and is a continuation-in-part of U.S. Provisional Patent Application No. 62/195,362, filed on Jul. 22, 2015, which subject matter is herein incorporated by reference in its entirety.

FIELD OF THE INVENTION

The present invention relates to a waterproof-dispensing apparatus for housing a continuous roll of rolling paper. The waterproof dispensing apparatus may also be provided with a small compartment for accommodating tobacco, or some other product, to be rolled within a discrete length of the rolling paper as well as smoking accessories like a such as a snubber or a tweezer/clip.

BACKGROUND OF THE INVENTION

Many end users prefer to roll their own smoking articles, such as cigars, cigarettes or the like. Papers or other sheets of material used as the outer wrapper for smoking articles are commonly made from leaves or pulp derived from a variety of sources, such as, wood, rice, cellulose, flax, plant fibers, packed herbs, palm leaf, tobacco, paper or some combination of the foregoing (collectively referred to herein as "rolling paper"). Rolling papers can be used to roll cigarette tobacco, cigar tobacco, pipe tobacco, tobacco substitutes, herbs, and most any other similar material. The papers are distributed and sold either in individual packs that include an outer packaging, which typically serves to protect and sometimes preserve the rolling papers therein or in a continuous roll of rolling paper To roll a smoking article, an end user typically dispenses a desired length of rolling paper from the continuous roll of roiling paper, cuts the desired length of rolling paper from a remainder of the continuous roll, manipulates the rolling paper to accommodate a desired amount of tobacco and thereafter places a desired amount of tobacco in the manipulated rolling paper, and finally rolls the rolling paper and tobacco into a generally tubular shape. The tubular shape is then sealed using adhesive or moisture, and allowed to dry to form an exterior shell, which contains the tobacco product. After sufficient drying, e.g., a few seconds or so for example the smoking article may then be smoked by the end user.

It is to appreciated that the rolling paper is generally extremely sensitive to moisture. The currently available packaging configurations leaves the rolling paper susceptible to damage from moisture absorption. It is understood that the longer period of time the rolling paper is stored, the greater the likelihood of absorption of moisture, resulting in damaged and unusable product. Such damage may be exacerbated in a packaging configuration where the rolling papers are bound in a booklet formation or stored on a continuous roll of rolling paper thereby exposing the rolling paper(s) to humidity in the environment.

What is desired is a packaging, an apparatus or a system that isolates the rolling paper from exposure to moisture, thus extending the shelf life of the packaged rolling paper. Furthermore, it would be highly desirable to accommodate the continuous roll of rolling paper in a dispensing apparatus which is sealed, in a waterproofed manner, in order to extend the useful shelf life of the product particularly for rolling papers fabricated of homogenized paper or other moisture sensitive materials. More specifically, what is desired is a dispensing apparatus that isolates the rolling paper from exposure to moisture and is designed for outdoor enthusiasts, such as skiers, snowboarders, kayakers/canoers, surfers, hikers, etc., who may come into contact with water or moisture during use, or users that are on the go that need a durable system for accommodating all of the accessories required to roll your own cigarette.

SUMMARY OF THE INVENTION

Wherefore, it is an object of the present invention to overcome the above mentioned shortcomings and drawbacks associated with the prior art.

Another object of the present invention is to provide a waterproof container for housing a continuous roll of rolling papers and also accommodating possibly a small quantity of tobacco or some other product to be rolled in the rolling paper.

A further object of the present invention is to provide an end cover or cap having a first portion which facilitates achieving a watertight seal with the exterior housing, and a second portion which releasably engages with an inner cylinder accommodating the continuous roll of rolling paper.

Still another object of the present invention is to provide a waterproof dispensing apparatus for rolling paper which can be easily and inexpensively manufactured from plastic materials.

Yet another object of the present invention is to threadingly engage the end cover or cap with the inner cylinder in such manner that further tightening of the end cover or cap, relative to the inner cylinder, facilitates both locking of the continuous roll of rolling paper relative to the inner cylinder and cutting, tearing or ripping of a desired dispensed length of rolling paper from a remainder of the continuous roll of rolling paper.

A still further object of the present invention is to provide the waterproof dispensing apparatus for rolling paper with a separate storage compartment which facilitates storage of a desired quantity of tobacco, or some other product, to be rolled within a discrete length of the roiling paper.

Still another object of the present invention is to provide the waterproof dispensing apparatus for rolling paper with a snubber or a snuffer which is sized and shaped to assist with extinguishing a lit or burning tobacco product, e.g., a cigarette for example, when the lit or burning tobacco product is brought into contact with a conical surface of the snubber or snuffer.

Another object of the present invention is to utilize a second exterior housing as a storage container to facilitate storage of a desired larger quantity of tobacco, or some other product, in an internal cavity of the exterior housing which is sealed, in a waterproof manner, by a removable closure.

Still another object is to provide a waterproof rolling paper dispensing apparatus comprising an inner cylinder being closed at one end and open at an opposite end thereof, the inner cylinder having an elongate slit extending from adjacent the closed end to at least adjacent the open opposite end of the inner cylinder, and the inner cylinder supporting a cutting edge which facilitates cutting of a desired length of rolling paper from a continuous roll of rolling paper to be accommodated within the inner cylinder; an exterior housing being closed at one end and open at an opposite end thereof, and the exterior housing defining an internal storage compartment for accommodating and storing the inner cylinder; and an end cover for releasably engaging with the open opposite end of the exterior housing and forming a waterproof seal therewith, and the end cover also releasably engaging with the open opposite end of the inner cylinder such that when the end cover is removed from engagement with the exterior housing to break the waterproof seal, the inner cylinder remains coupled to the end cover and is removed with the end cover

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE PREFERRED EMBODIMENTS

The present invention will be understood by reference to the following detailed description, which should be read in conjunction with the appended drawings. It is to be appreciated that the following detailed description of various embodiments is by way of example only and is not meant to limit, in any way, the scope of the present invention.

Figure 1:
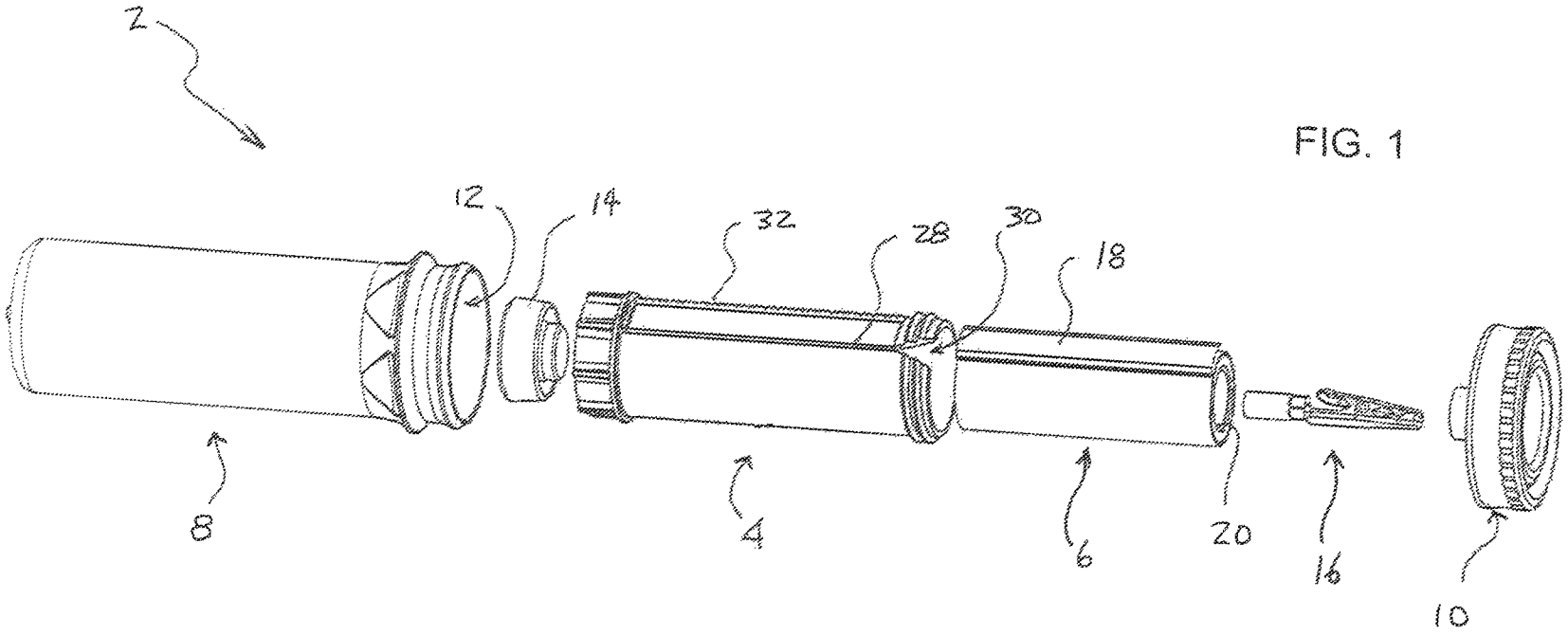
FIG. 1 is a diagrammatic exploded perspective view showing the components of the waterproof dispensing apparatus for housing a continuous roll of rolling paper according to the present invention.
Figure 2:
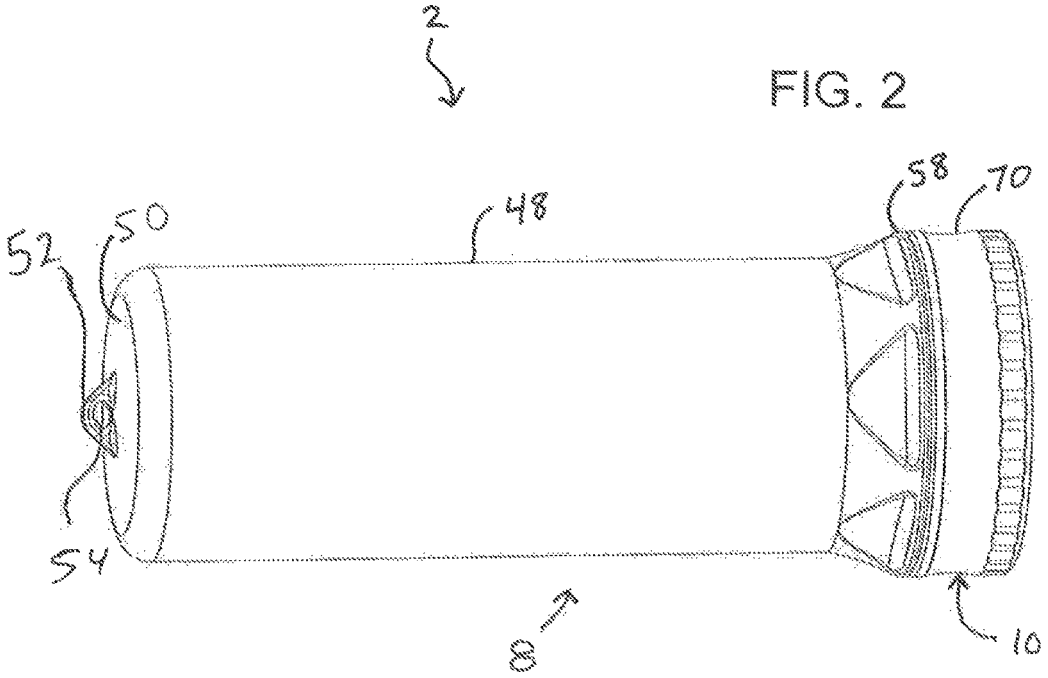
FIG. 2 is a diagrammatic perspective view of the waterproof dispensing apparatus of FIG. 1, following assembly of the depicted components.

Turning first to FIG. 1, a brief description concerning the various primary components of the present invention will first be briefly discussed. This will then be followed by a detailed discussion of each individual component as well as the associated features. Lastly, a detailed description concerning the interaction and use of the various components will be provided.

As can be seen in this Figure, the waterproof dispensing apparatus 2 for rolling paper generally comprises an inner cylinder 4 which accommodates a conventional tube of rolling paper 6, an exterior housing 8 which accommodates the inner cylinder 4 and the tube of rolling paper 6. An end cover or cap 10 assists with forming a waterproof seal by engaging with an open end 12 of the exterior housing 8. In addition, a snubber or snuffer 14 and a conventional "alligator clip" 16 are typically included. With respect to the conventional tube of rolling paper 6, it generally comprises an elongate continuous length of rolling paper 18 which is wound around a conventional cardboard core or tube 20.

A small elongate strip of glue (not shown in detail) is applied adjacent one edge of the elongate rolling paper 18 to facilitate adhering the glued edge of the rolling paper 18 to a surface of the rolling paper 18 once the user cuts and rolls, in a conventional manner, a cigarette, for example, by hand from a cut length of rolling paper 18.

Turning now to FIGS. 1, 3-5 and 12-14, a detailed description concerning the inner cylinder 4 will now be provided. As shown in these figures, the inner cylinder 4 generally comprises a hollow cylindrical surface 22 which is manufactured from polycarbonate, for example. The inner cylinder 4 is open at a first end 24 thereof and closed at an opposed second end thereof by a base wall 26. The inner cylinder 4 typically has a length of about 3±½ inches, a thickness of about 1/64 to 1/16 of an inch and a diameter of about 1±⅛ inches.

Figure 12:
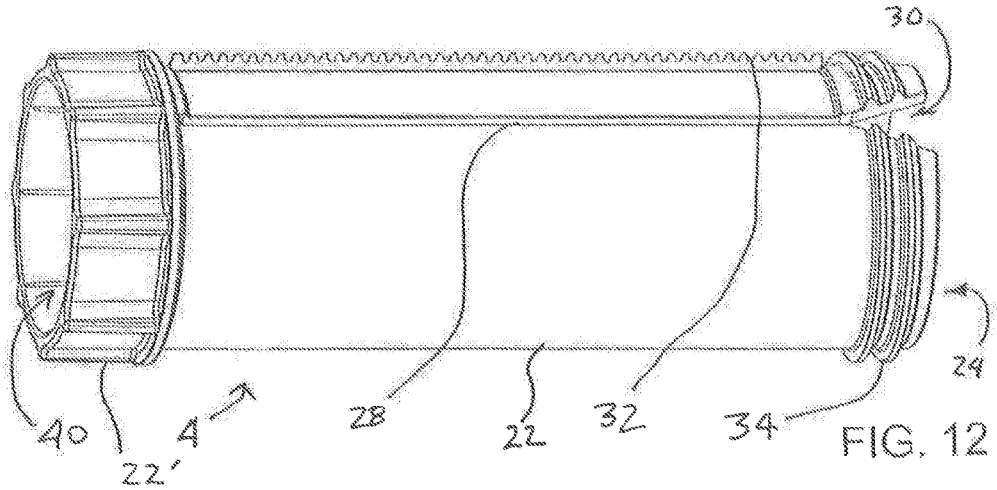
FIG. 12 is a diagrammatic perspective view of the inner cylinder according to the present invention.
Figure 13:
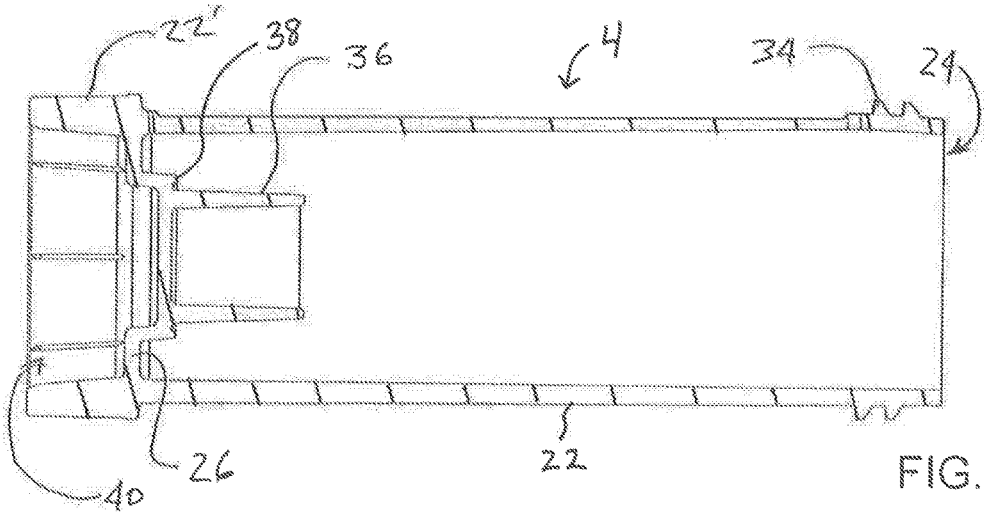
FIG. 13 is a diagrammatic cross sectional view of the inner cylinder of FIG. 12.
Figure 14:
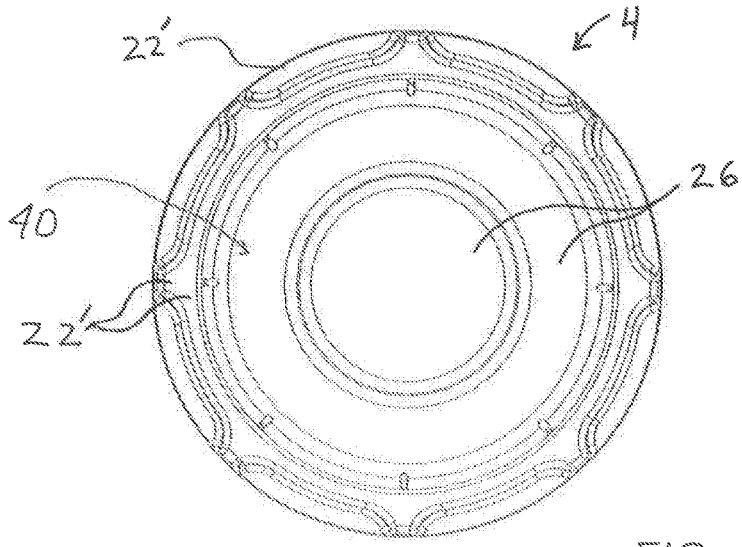
FIG. 14 is a diagrammatic left end view of the inner cylinder of FIG. 12.
Figure 16:
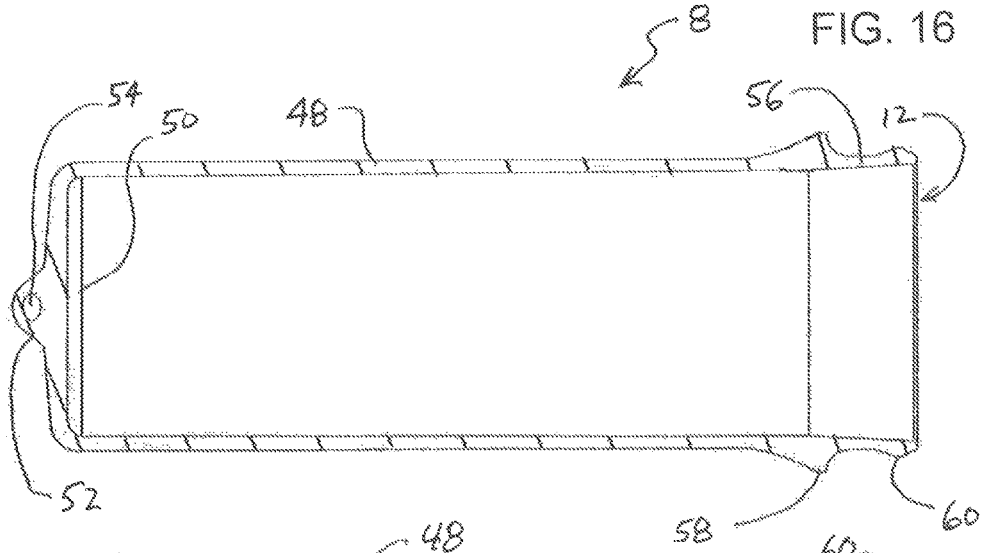
FIG. 16 is a diagrammatic cross sectional view of the exterior housing of FIG. 15 along section line 15C-15C in FIG. 15.
Figure 15:
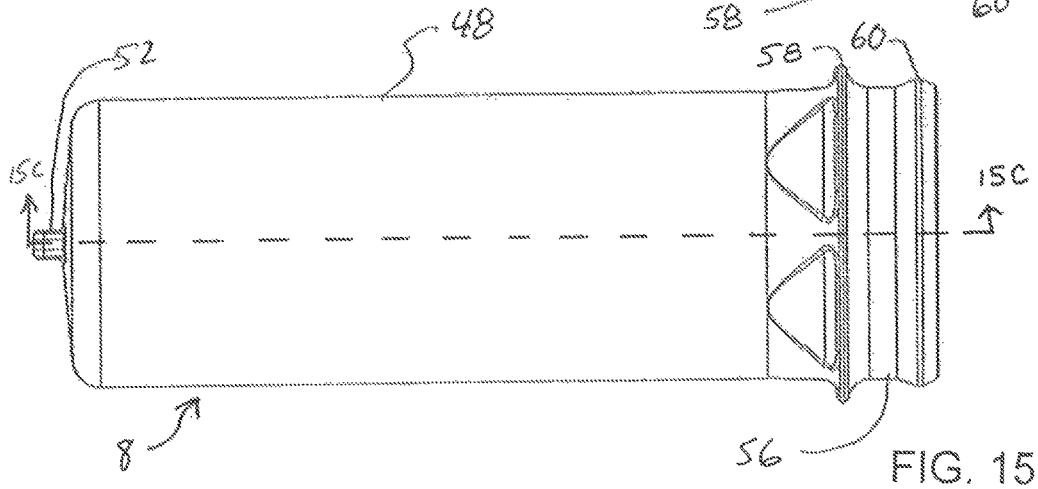
FIG. 15 is a diagrammatic elevational view of the exterior housing according to the present invention.
Figure 17:
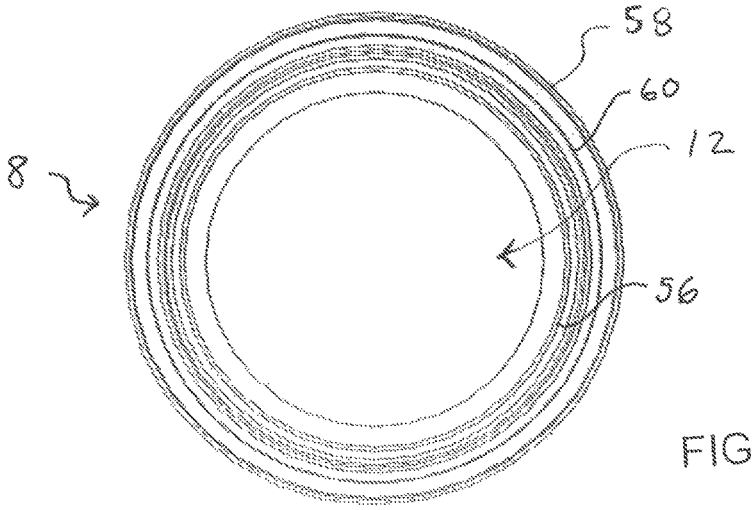
FIG. 17 is a diagrammatic right side end view of the exterior housing of FIG. 15.
Figure 18:
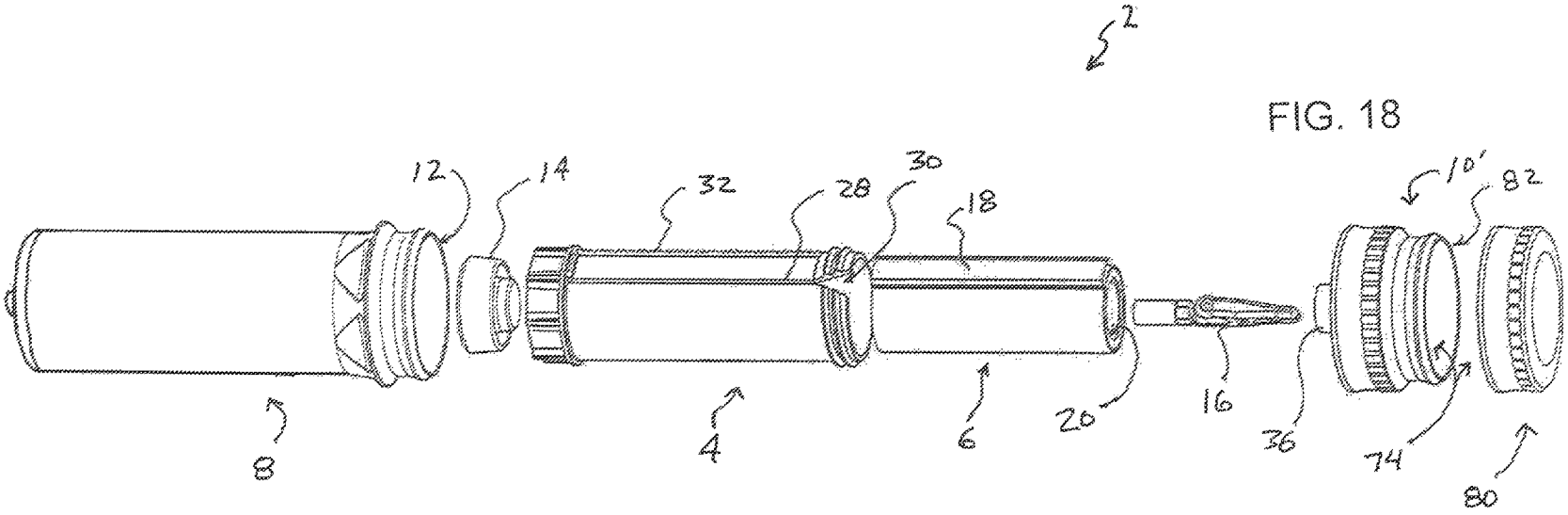
FIG. 18 is a diagrammatic exploded view showing the components of a second embodiment of the waterproof dispensing apparatus according to the present invention.
Figure 19:
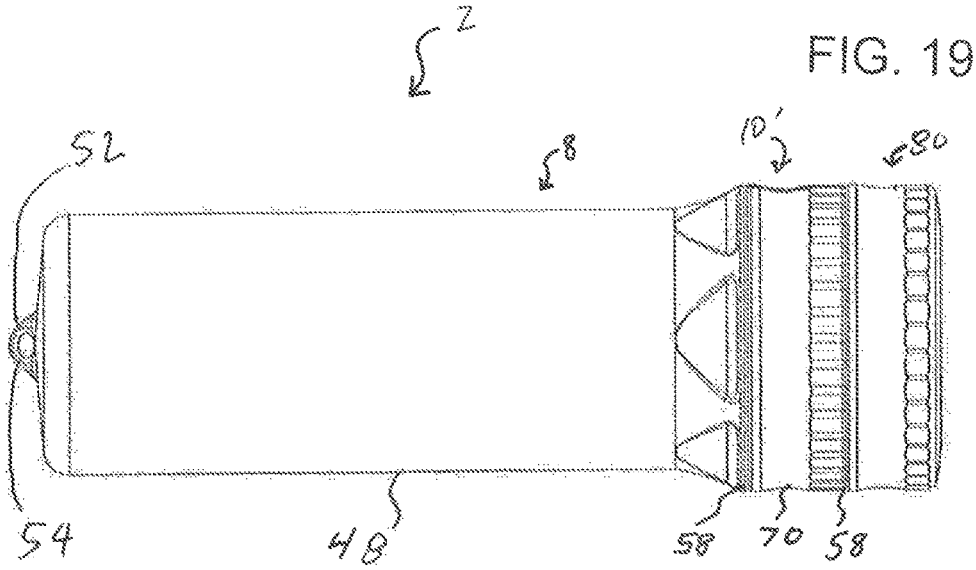
FIG. 19 is a diagrammatic elevational view of the waterproof dispensing apparatus of FIG. 18, following assembly of the depicted components.
Figure 20:
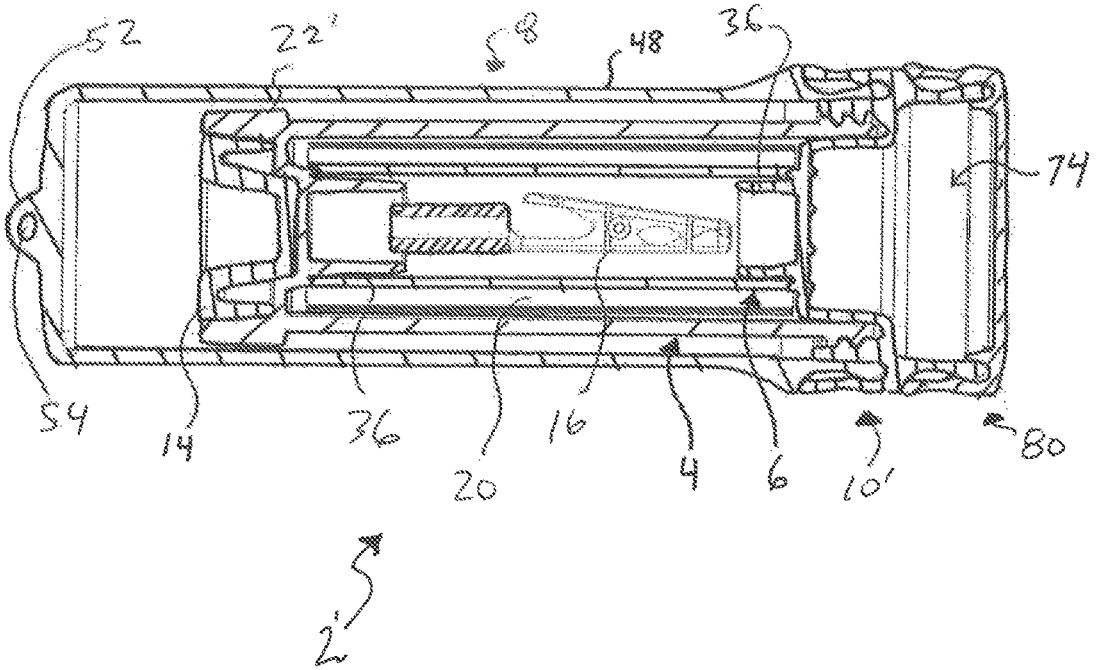
FIG. 20 is a diagrammatic cross sectional view of the waterproof dispensing apparatus of FIG. 19.
Figure 21:
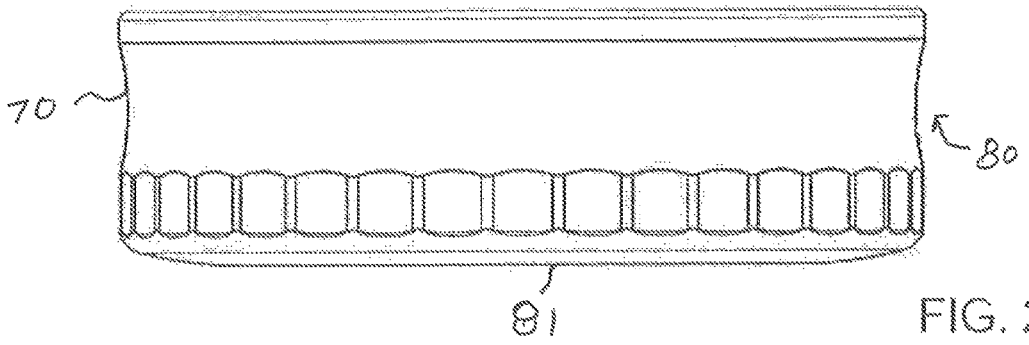
FIG. 21 is a diagrammatic elevational view of the removable closure according to the present invention.
Figure 22:
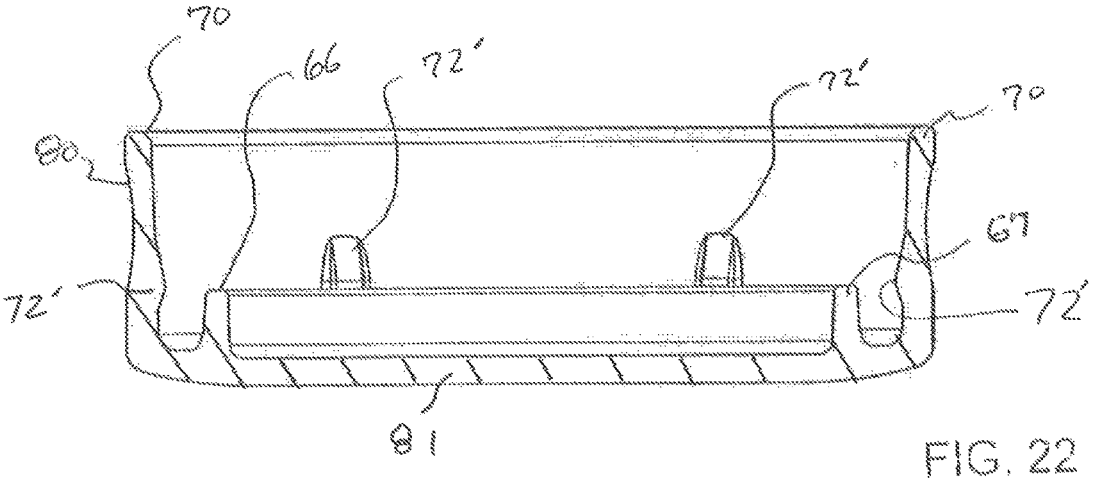
FIG. 22 is a diagrammatic cross sectional view of the removable closure of FIG. 21.
Figure 23:
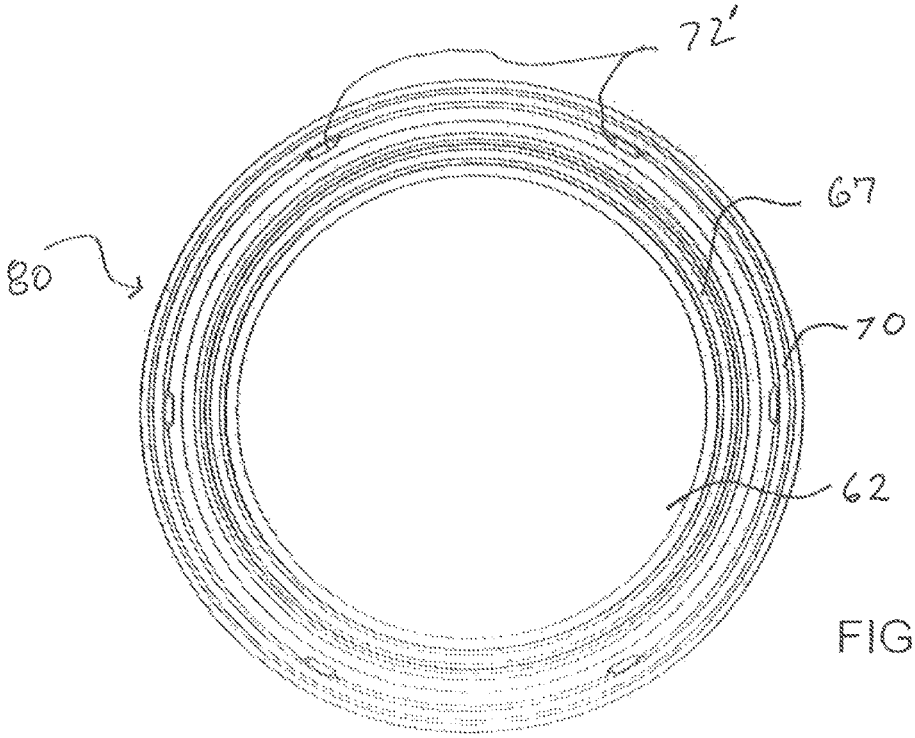
FIG. 23 is a diagrammatic plan view of the removable closure of FIG. 21.
Figure 24:
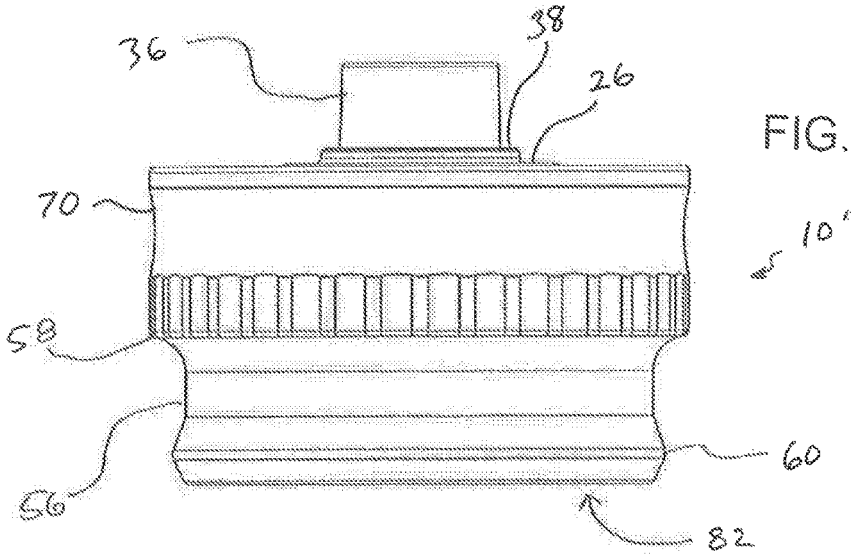
FIG. 24 is a diagrammatic elevational view of the end cover or cap with an integrated storage compartment according to the present invention.
Figure 25:
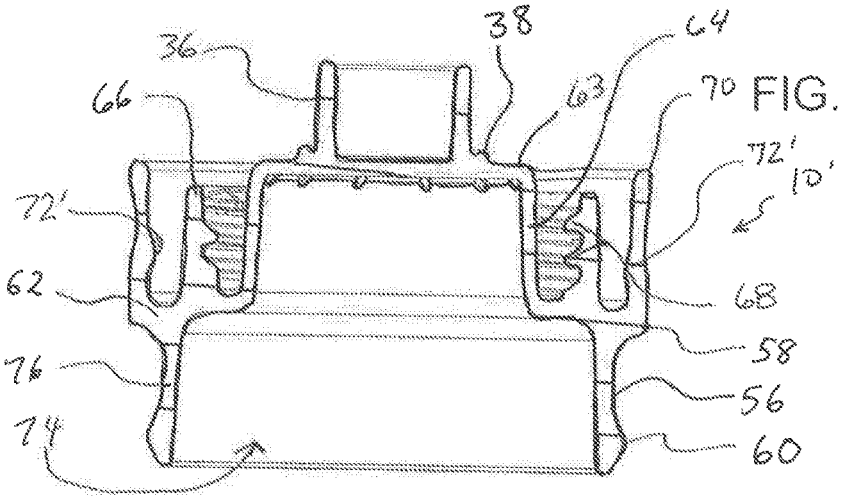
FIG. 25 is a diagrammatic cross sectional view of the end cover or cap with the integrated storage compartment of FIG. 24.
Figure 26:
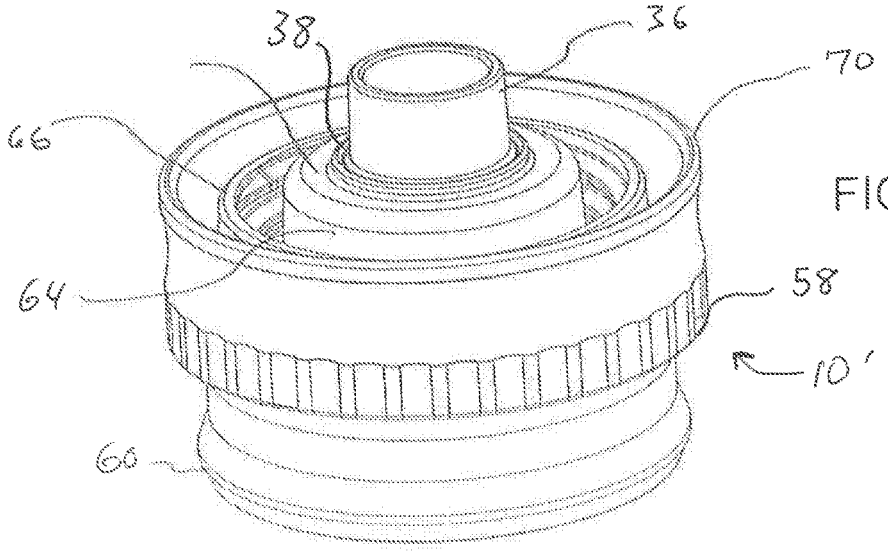
FIG. 26 is a diagrammatic perspective view of the end cover or cap with the integrated storage compartment of FIG. 24.

As shown in FIGS. 1 and 12, for example, an elongate narrow slit 28 is provided and extends along the entire length of the inner cylinder 4, from directly adjacent the base wall 26 to the open first end 24 of the inner cylinder 4. The narrow slit 28 flares or tapers 30 into a wider dimension as the narrow slit 28 approaches the open first end 24. The narrow slit 28 typically has a width of about 1/64 to 1/16 of an inch which is sufficiently wide enough to permit the roiling paper 18 to be threaded or passed therethrough for dispensing, as discussed below in further detail. The flare or taper 30 of the narrow slit 28 also facilitates passing or threading a free leading end of the rolling paper 18 therethrough.

As also shown in FIGS. 1 and 12, for example, a cutting edge 32 projects radially outward away from the exterior cylindrical surface 22 of the inner cylinder 4 and is spaced a small distance, e.g., 1/64 to about ⅛ of an inch or so, away from the narrow slit 28. The cutting edge 32 typically comprises a serrated edge, e.g., a plurality of spaced apart cutting teeth extending along the length of the exterior cylindrical surface of the inner cylinder 4. The cutting edge 32 is utilized to cut a desired length of rolling paper 18 from a remainder of the supply of rolling paper wrapped around the tube 20. The cutting edge 32 extends along the entire length of the inner cylinder 4, from directly adjacent the base wall 26 to the open first end 24 of the inner cylinder 4. The cutting edge 32 extends parallel to the narrow slit 28 but is spaced from the narrow slit 28, e.g., by a distance of about ½ inch or so. Thus, once a desired length of rolling paper 18 is cut from a remainder of the continuous roll of rolling paper, a sufficient length of the rolling paper 18 still remains and extends out through the narrow slit 28. Then the rolling paper 18 can be readily and easily grasped by a user to facilitate continued use, i.e., cutting another desired length of rolling paper 18 from the tube of rolling paper 6.

The exterior cylindrical surface 22 of the inner cylinder 4, adjacent the open first end 24 thereof, carries an external thread 34, and the purpose of thread this will become apparent from the following description.

An inwardly facing surface of the base wall 26 of the inner cylinder 4 supports an axially extending centrally located post 36. A free end of the post 36 is sized and shaped to be received within one end of the conventional tube of rolling paper 6 and assist with both centering and dispensing, e.g., unrolling of the rolling paper 18 from the tube 20, as described below in further detail, The post 36 typically has a length of about ¼ of an inch or so, and a diameter of about ⅜ of an inch. Opposite the free end thereof, the post 36 is spaced and separated from the base wall 26 of the inner cylinder 4 by a stop surface 38. This stop surface 38 projects from the base wall 26 of the inner cylinder 4 and spaces one end of the tube 6 of rolling paper 6 from the base wall 26 of the inner cylinder 4 and the stop surface 38 assists with dispensing (unrolling) and cutting of the rolling paper 18 from the tube 20.

A reinforced cylindrical surface 22' extends away from an opposed, second surface of the base wall 26 of the inner cylinder 4. This reinforced cylindrical surface 22', along with the second surface of the base wall 26 of the inner cylinder 4 together, define a snuffer cavity 40. This snuffer cavity 40 has a length of about ⅜ of an inch or so and a diameter of about 13/16 of an inch or so and is sized and shaped to accommodate the snuffer or snubber 14, described below in further detail.

Figure 6:
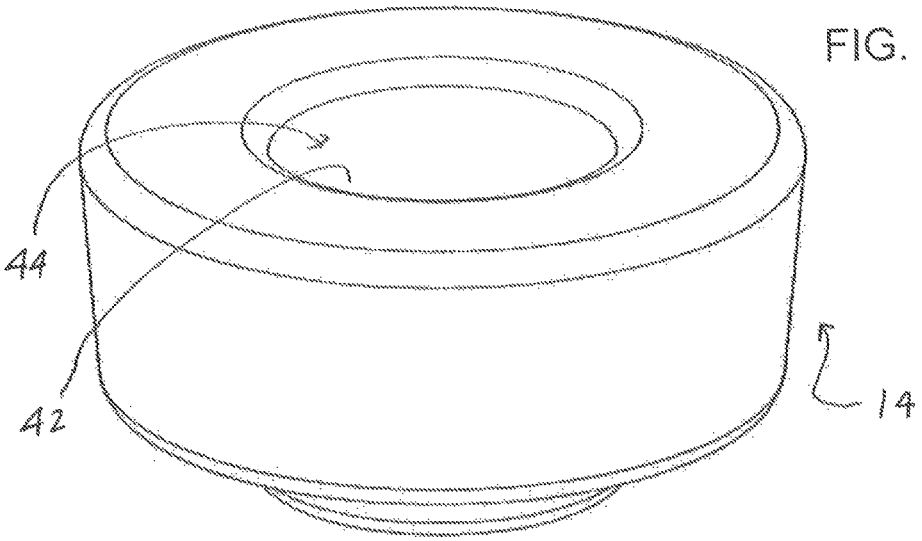
FIG. 6 is a diagrammatic perspective view of the snuffer or snubber according to the present invention.
Figure 7:
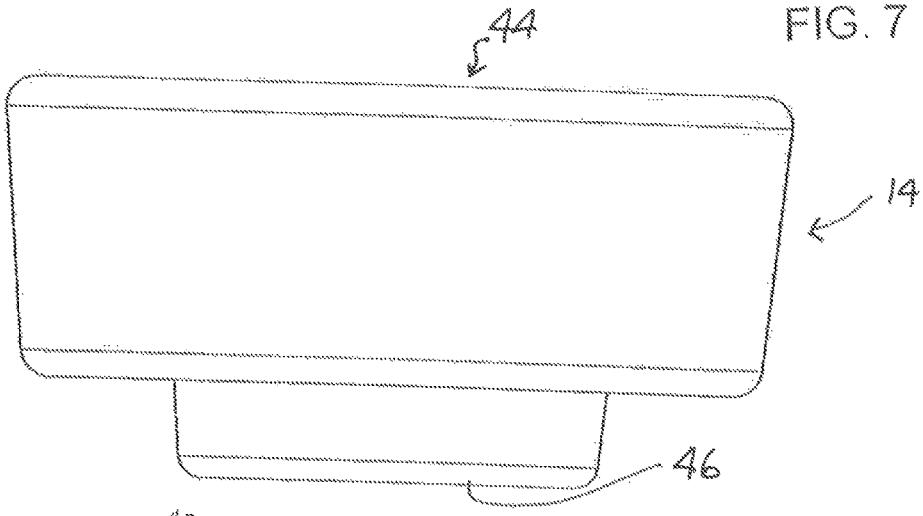
FIG. 7 is a diagrammatic elevational view of the snuffer or snubber of FIG. 6 according to the present invention.
Figure 8:
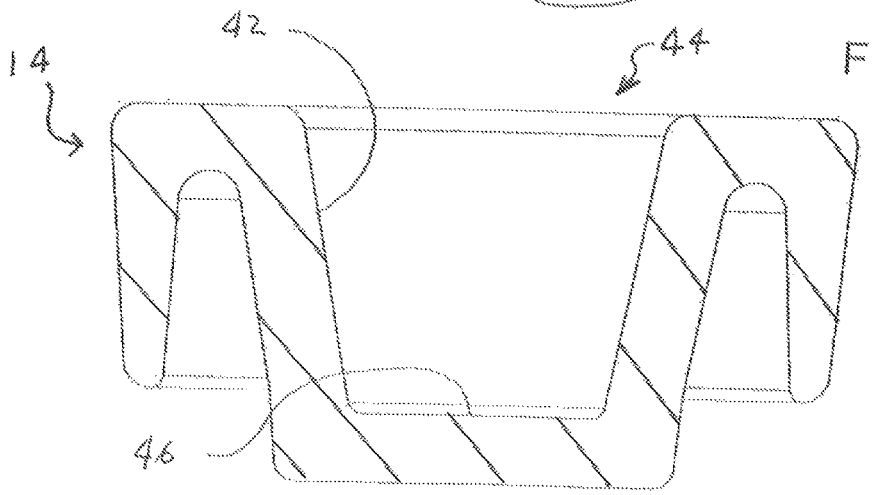
FIG. 8 is a diagrammatic cross sectional view of the snuffer or snubber of FIG. 6.

Turning now to FIGS. 6-8, a detailed description concerning the snubber or snuffer 14 will now be provided. The snubber or snuffer 14 is typically manufactured from a non-flammable material, for example. As shown here, the snuffer 14 generally comprises a centrally located aperture 42 which is sized and shaped to assist with extinguishing a lit or burning tobacco product, e.g., a cigarette for example, when the lit or burning tobacco product is brought into contact with the centrally located aperture 42 of the snubber or snuffer 14. The centrally located aperture 42 is generally conical in shape and gradually tapers from an open end 44 thereof to a closed bottom surface 46 thereof. The conical shape of the snubber or snuffer 14 is sized and shaped to assist with extinguishing a lit or burning tobacco product.

Turning now to FIGS. 1-3 and 15-17, a detailed description concerning the exterior housing 8 will now be provided. As shown in these figures, the exterior housing 8, which is manufactured from polyproplyiene, for example, and generally comprises a hollow cylindrical surface 48. The exterior housing 8 has a first open end 12 and is dosed, by a base wall 50, at an opposed second end thereof. The exterior housing 8 typically has a length of about 3⅛±½ inches, a thickness of about 1/64 to 1/16 of an inch and a diameter of about 1¼±⅛ inches. An outwardly facing exterior surface of the base wall 50 of the exterior housing 8 has a thickened nub 52 with an aperture 54 extending therethough. The aperture 54 is sized and shaped to receive a conventional key ring, a conventional chain or some other conventional coupling member (not shown) which facilitates releasable attachment of the exterior housing 8 to a desired article of clothing of the user, for example, or to some other desired object.

A generally cylindrical sealing surface 56 is formed along and extends from the open end 12 of the exterior housing 8 only a small distance toward the closed end of the exterior housing 8, e.g., a distance of about ⅜ of an inch or so. The generally cylindrical sealing surface 56 terminates at an external cylindrical shoulder 58 which has a diameter which is larger than a diameter of the generally cylindrical sealing surface 56. An end surface of the external cylindrical shoulder 58, which faces toward the open end 12 of the exterior housing 8, forms an abutment surface which abuts against and mates with an end surface of the end cover or cap 10 in order to form a first contact point of the waterproof seal to be achieved between the end cover or cap 10 and the exterior housing 8. A free perimeter edge of generally cylindrical sealing surface 56 gradually increases in thickness so as to form a thickened annular section 60, located immediately adjacent but slightly spaced from the open end 12 of the exterior housing 8, and this thickened annular section 60 has a thickness which is slightly larger than a thickness of a remainder of the generally cylindrical sealing surface 56, the purpose of which will become apparent from the following description.

Turning now to FIGS. 1-3 and 9-11, a detailed description concerning the end cover or cap 10 will now be provided. The end cover or cap 10 is designed to engage with both the open end 24 of the inner cylinder 4 as well as the open end 12 of the exterior housing 8. As generally shown, the central section of an inwardly facing surface of a base wall 63 of the end cover or cap 10 supports a centrally located post 36. This post 36 projects axially away from the base wall 63 of the end cover or cap 10 and is sized and shaped to be received within a second opposed end of the conventional tube of rolling paper 6. The second post 36 also assists with both centering and dispensing, e.g., unrolling of the rolling paper 18 from the tube 20. The second post 36 typically has a diameter of about ⅜ of an inch and length of about ¼ of an inch or so. A stop surface 38 of the base wall 63 of the end cover or cap 10, the purpose of which will become apparent from the following description, is spaced from the post 36.

Figure 11:
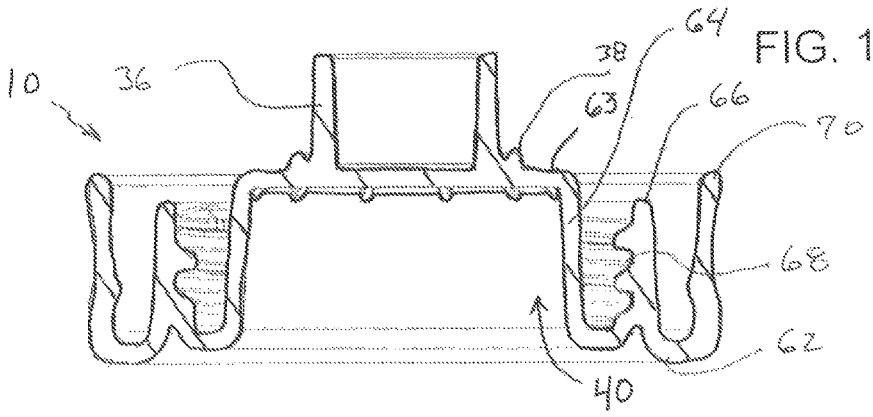
FIG. 11 is a diagrammatic cross sectional view of the end cover or cap of FIG. 9.

An innermost annular sleeve 64 projects axially and substantially normal from the base wall 63 to the end wall 62 of the end cover or cap 10. As best shown in FIG. 11, a cavity 40 is defined by the radially inward surface of the innermost annular sleeve 64 and an outward facing surface of the base wall 63.

An annular intermediate sleeve 66 projects substantially normal from the end wall 62 of the end cover or cap 10 and this intermediate sleeve 66 surrounds the innermost annular sleeve 64, the base wall 63 and the stop surface 38. An inwardly facing surface of the annular intermediate sleeve 66 carries an internal thread 68. This internal thread 68 is sized and shaped to matingly engage with the external thread 34 of the inner cylinder 4 while the outwardly facing surface of the innermost annular sleeve 64 is designed to engage with the inwardly facing surface of the inner cylinder 4. The end cover or cap 10, when threadedly engaged with both the inner cylinder 4 and the exterior housing 8, assists with captively retaining the tube of rolling paper 6 therein. Additionally, the end cover or cap 10 also assists with dispensing of the rolling paper 18 from the tube 20.

Figure 10:
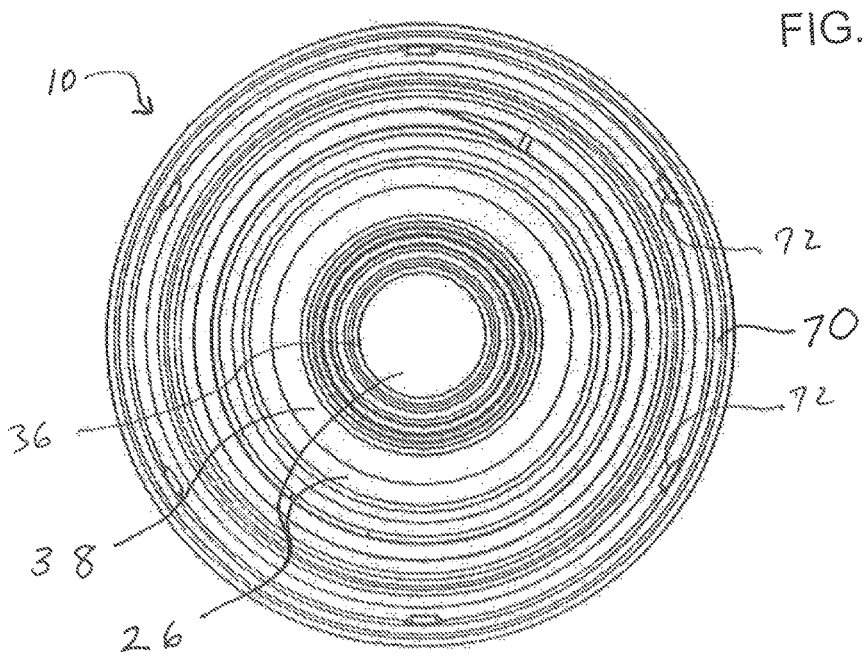
FIG. 10 is a diagrammatic plan view of the end cover or cap of FIG. 9.
Figure 9:
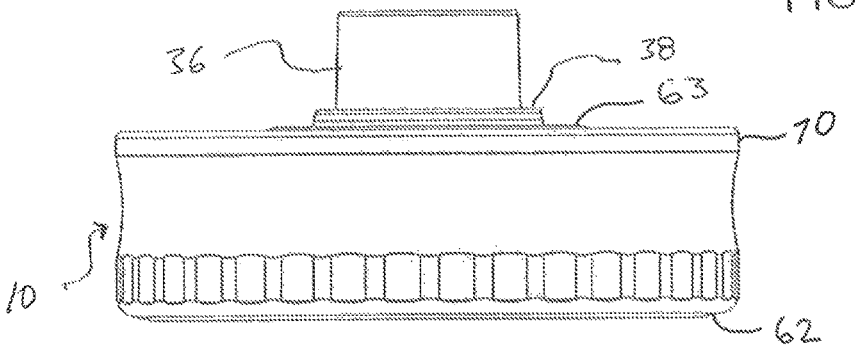
FIG. 9 is a diagrammatic elevational view of the end cover or cap according to the present invention.

A radially outermost annular sleeve 70 is spaced from and surrounds the annular intermediate sleeve 66 of the end cover or cap 10. The radially outermost annular sleeve 70 projects substantially normal from the end wall 62 of the end cover or cap 10. A radially inwardly facing surface of the radially outermost annular sleeve 70 of the end cover or cap 10 is also generally a smooth cylindrical surface but is provided with a plurality of, e.g., three to fifty, inwardly facing protrusions 72, and more preferably six inwardly facing protrusions 72 as shown in FIG. 10, These inwardly facing protrusions 72 are located so as to engage with the thickened annular section 60 of the exterior housing 8 and form a snug, but releasable, sealing fit therewith. A radially outwardly facing surface of the annular intermediate sleeve 66 of the end cover or cap 10 is a smooth cylindrical surface which is sized and shaped to intimately engage with an inwardly facing cylindrical surface of the exterior housing 8 and a waterproof seal is formed thereby following engagement of the inwardly facing protrusions 72 with the thickened annular section 60. The spacing between the annular intermediate sleeve 66 and the inwardly facing protrusions 72 of the radially outermost annular sleeve 70 is slightly less than the thickness of the thickened annular section 60 of the exterior housing 8. Thus, when the end cover or cap 10 engages with the exterior housing 8, the thickened annular section 60 of the exterior housing 8 is tightly sandwiched between the annular intermediate sleeve 66 and the radially outermost annular sleeve 70 of the end cover or cap 10. This ensures that the inwardly facing surface of the thickened annular section 60 sealingly engages with the outwardly facing cylindrical surface of the annular intermediate sleeve 66 to achieve a waterproof seal therebetween.

Figure 3:
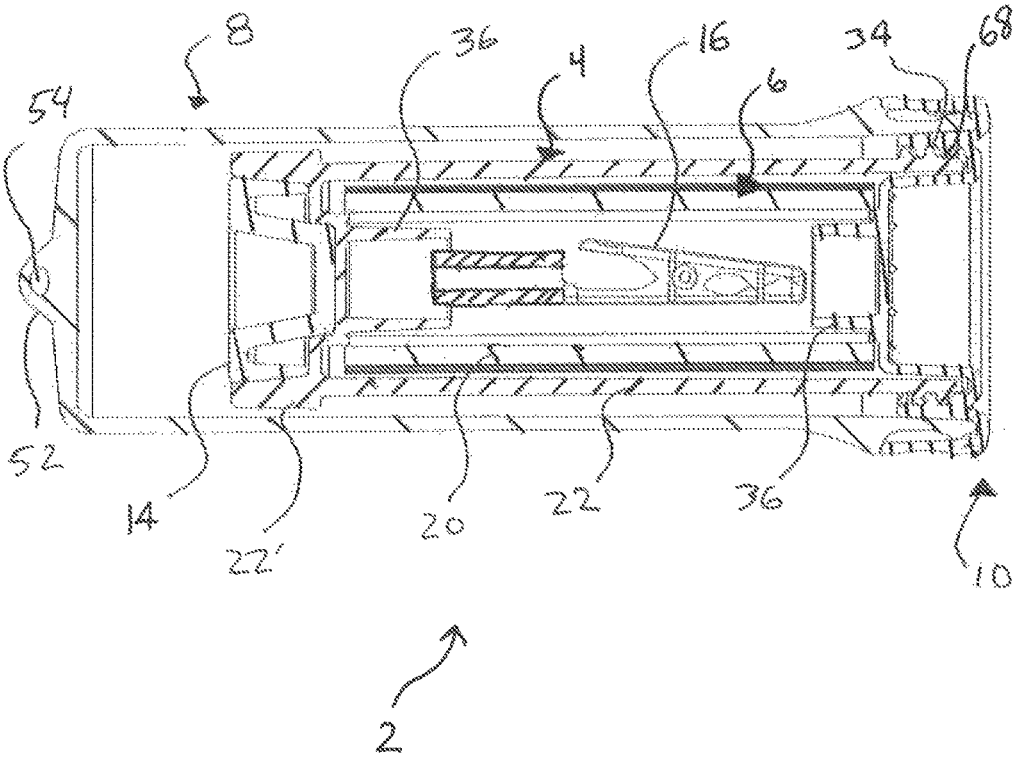
FIG. 3 is a diagrammatic cross sectional view of the assembled waterproof dispensing apparatus of FIG. 2.
Figure 4:
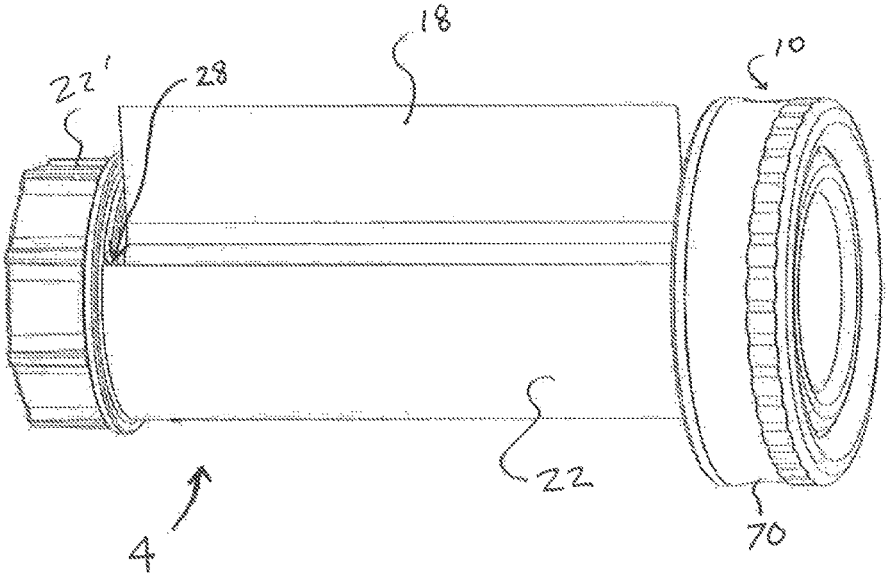
FIG. 4 is a diagrammatic perspective view of the inner cylinder assembled with the end cover or cap.
Figure 5:
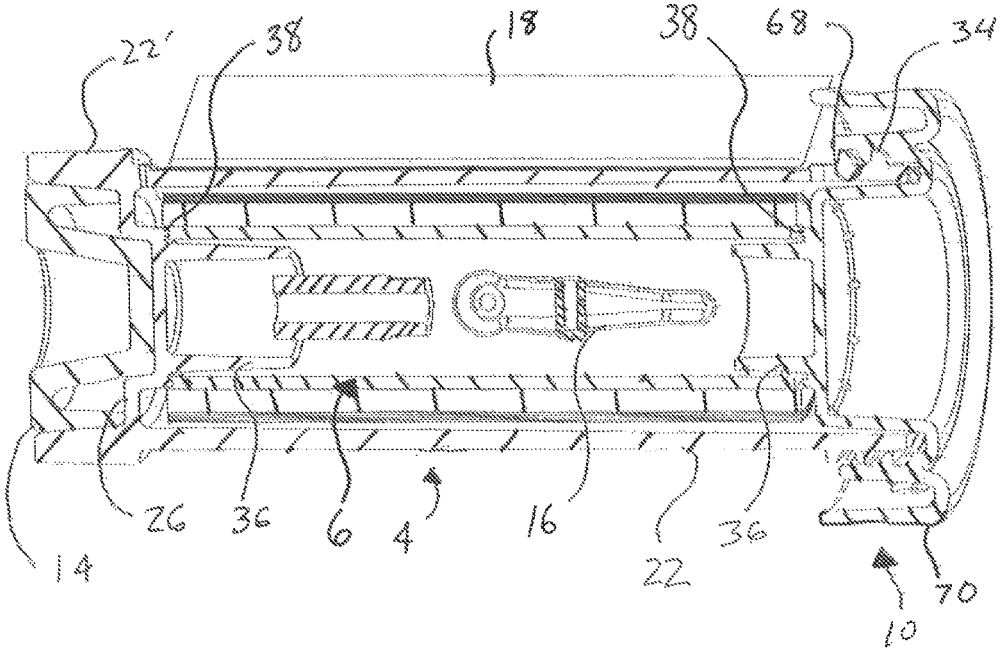
FIG. 5 is a diagrammatic cross sectional view of the inner cylinder and assembled with the end cover or cap of FIG. 4.

As shown in FIGS. 3-5, the end cover or cap 10 is normally threadedly engaged with the external threaded 34 of the inner cylinder 4. Once a desired tube of rolling paper 6 is accommodated within the chamber of the inner cylinder 4 and the paper is threaded though the narrow slit 28, the user will then twist the end cover or cap 10 so that it is typically only partially threaded onto the inner cylinder 4, e.g., the end cover or cap 10 is unthreaded therefrom by ½ to ¼ of a turn or so. Such unthreading sufficiently spaces the pair of stop surfaces 38 of the inner cylinder 4 and the end cover or cap 10 a small distance away from the opposed ends of tube of rolling paper 6. Such spacing of the pair of stop surfaces 38 a small distance away from the tube of rolling paper 6 generally facilitates unrestricted unwinding of the rolling paper 18 from the tube 20.

However, once a desired length of rolling paper 18 is unwound from the tube 20, the end cover or cap 10 is then fully threaded onto the inner cylinder 4 so that the pair of stop surfaces 38 directly abut against the opposed ends of the tube of rolling paper 6. Such abutting engagement of the pair of stop surfaces 38 with the opposed ends of the tube of rolling paper 6 thereby temporarily prevents any further relative rotation of the tube 20 with respect to the stop surfaces 38 and/or the inner cylinder 4. This, in turn, prevents further dispensing of the rolling paper 18 from the tube 20 and renders it much easier for a user to tear, rip or cut, via the cutting edge 32 in a conventional manner, the desired length of rolling paper 18 which was dispensed from the inner cylinder 4.

Due to the end cover or cap 10 being normally threadedly engaged with the inner cylinder 4, each time the end cover or cap 10 is removed from the exterior housing 8, the inner cylinder 4 is also simultaneously removed with the end cover or cap 10. This permits the exterior housing 8 to remain releasably attached to a desired article of clothing of the user, for example, while the user merely removes the end cover or cap 10 and the inner cylinder 4. Next, the user unrolls a desired length of rolling paper 18 from the tube 20, and tears or cuts a desired length of the rolling paper 18 from a remaining supply of the rolling paper 18 contained on the cardboard tube 20, as described above.

Turning now to FIGS. 18-26, a modification of the present invention will now be described. As this embodiment is somewhat similar to the previously discussed embodiment, identical elements will be given identical reference numerals.

According to this variation, the end cover or cap 10 has all of the features of the previously discussed end cover or cap 10, as well as an additional or enlarged storage compartment 74 integrated therein. This storage compartment 74 is provided to facilitate storage of a desired quantity of tobacco or some other consumable product. As with the end cover or cap 10, the central section of an inwardly facing surface of the end cover or cap 10' supports a centrally located post 36 which is sized and shaped to be received within a second opposed end of the conventional tube of rolling paper 6 and assist with both centering and dispensing, e.g., unrolling of the rolling paper 18 from the tube 20. The post 36 is spaced from a stop surface 38 supported by the end wall 62 of the end cover or cap 10. An innermost annular sleeve 64 projects substantially normal from the end wall 62 of the end cover or cap 10' and the innermost annular sleeve 64 is integral with the base wall 63.

An annular intermediate sleeve 66 projects substantially normal from the end wall 62 of the end cover or cap 10' and this intermediate sleeve 66 surrounds the innermost annular sleeve 64, the stop surface 38 and the post 36. An inwardly facing surface of the annular intermediate sleeve 66 carries an internal thread 68 which is sized and shaped to matingly engage with the external thread 34 of the inner cylinder 4 while the outwardly facing surface of the inwardly facing surface of the innermost annular sleeve 64 is designed to engage with the inwardly facing surface of the inner cylinder 4.

An radially outermost annular sleeve 70 is spaced from and surrounds the annular intermediate sleeve 66 of the end cover or cap 10. The radially outermost annular sleeve 70 projects substantially normal from the end wall 62 of the end cover or cap 10. A radially inwardly facing surface of the radially outermost annular sleeve 70 of the end cover or cap 10 is also generally a smooth cylindrical surface but is provided with a plurality of, e.g., three to fifty, inwardly facing protrusions 72, and more preferably six inwardly facing protrusions 72, similar to the arrangement shown in FIG. 10. These inwardly facing protrusions 72 are located to engage with the thickened annular section 60 of the exterior housing 8 and form a snug, but releasable, fit therewith. A radially outwardly facing surface of the annular intermediate sleeve 66 of the end cover or cap 10' is a smooth cylindrical surface which is sized and shaped to intimately engage with an inwardly facing cylindrical surface of the exterior housing 8 and form a waterproof seal therewith due to the engagement of the inwardly facing protrusions 72 with the thickened annular section 60. The spacing between the annular intermediate sleeve 66 and the inwardly facing protrusions 72' of the radially outermost annular sleeve 70 is slightly less than the thickness of the thickened annular section 60 of the exterior housing 8 so that when the end cover or cap 10 engages with the exterior housing 8, the thickened annular section 60 is sandwiched between the annular intermediate sleeve 66 and the outermost annular sleeve 70 and the inwardly facing surface of the thickened annular section 60 sealing engages with the outwardly facing cylindrical surface of the annular intermediate sleeve 66 to achieve a waterproof seal therebetween.

As generally shown in these figures, a compartment cylindrical wall 76 extends away from a second surface of the end wall 62 of the end cover or cap 10' and this compartment cylindrical wall along with the base wall 63 and the end wall 62 of the end cover or cap 10' together define the storage compartment 74 which facilitates storage of a desired product. This storage compartment 74 typically has a length of about ¼ to about an inch or so, possibly longer depending upon the particular application, and a diameter of about 13/16 of an inch or so.

Each of the innermost annular sleeve 64, the base wall 63, the end wall 62 and the cylindrical compartment wall 76 are shown here being integral with the cover or cap 10. A removable closure lid or cap 80 is provided as a separate component for releasably closing and sealing the open end 82 of the storage compartment 74. Such closing and sealing of the storage compartment 74 is preferably achieved in a waterproof manner similar to that described above. In order to facilitating this, a generally cylindrical sealing surface 56 is formed in and extends from the open end 82 of the storage compartment 74 only a small distance toward the closed end of the storage compartment 74, e.g., a distance of about ⅜ of an inch or so. The generally cylindrical sealing surface 56 terminates at an external cylindrical shoulder 58 which has a diameter which is larger than a diameter of the generally cylindrical sealing surface 56. An end surface of the external cylindrical shoulder 58, which faces toward the open end 82 of the storage compartment 74, forms an abutment surface which abuts against and mates with an end surface of the removable closure lid or cap 80 in order to form a first contact point of the waterproof seal to be achieved between the removable closure 80 and the storage compartment 74, A free perimeter edge of generally cylindrical sealing surface 56 gradually increases in thickness so as to form a thickened annular section 60, located immediately adjacent the open end 82 of the storage compartment 74. This thickened annular section 60 has a thickness which is slightly larger than a thickness of a remainder of the generally cylindrical sealing surface 56.

A radially outermost annular sleeve 70 projects substantially normal from a perimeter edge of an end wall 81 of the removable closure 80. A radially inwardly facing surface of the radially outermost annular sleeve 70 of the removable closure 80 is generally a smooth cylindrical surface but is provided with a plurality of, e.g., three to fifty or so, inwardly facing protrusions 72, and more preferably six inwardly facing protrusions 72'. These inwardly facing protrusions 72' are located to engage with the thickened annular section 60 of the storage compartment 74 and form a snug, but releasable, fit therewith.

A radially inner annular sleeve 67 is spaced radially inward from the outermost annular sleeve 70 of the removable closure 80 and projects substantially normal from the end wall 81 of the removable closure 80. A radially outwardly facing surface of the inner annular sleeve 67 of the removable closure 80 also forms a smooth cylindrical surface which is sized and shaped to intimately engage with an inwardly facing thickened annular section 60 of the cylindrical surface of the storage compartment 74. The spacing between the inner annular sleeve 67 and the radially outermost annular sleeve 70 of the removable closure 80 is slightly less than the thickness of the thickened annular section 60 of the storage compartment 74. Such spacing ensures that when the removable closure 80 engages with open end 82 of the storage compartment 74, the thickened annular section 60 of the storage compartment 74 is sandwiched between the radially inner annular sleeve 66 and the radially outermost annular sleeve 70. Then thickened annular section 60 of the storage compartment 74 is captively retained by the plurality of inwardly facing protrusions 72 to form an interference fit which forms a second contact point for the waterproof seal between the removable closure 80 and the storage compartment 74.

The storage compartment 74 is typically manufactured from polyproplylene, for example. It is to be appreciated that the overall size and shape of the storage compartment 74 can vary without departing from the spirit and scope of the present invention.

Figure 27:
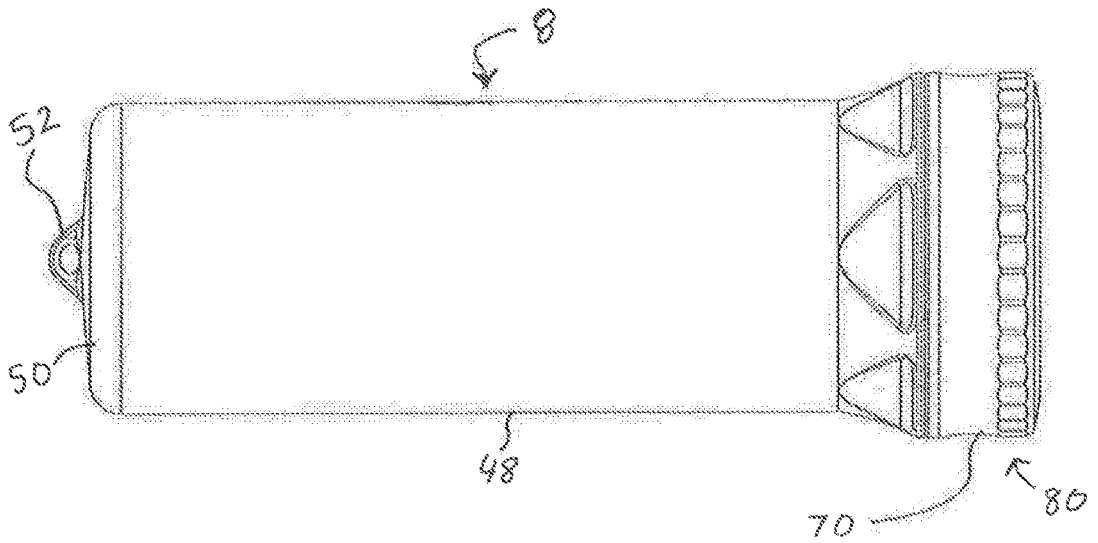
FIG. 27 is a diagrammatic elevational view of the waterproof dispensing apparatus being used as a storage container following assembly with a releasable closure.
Figure 28:
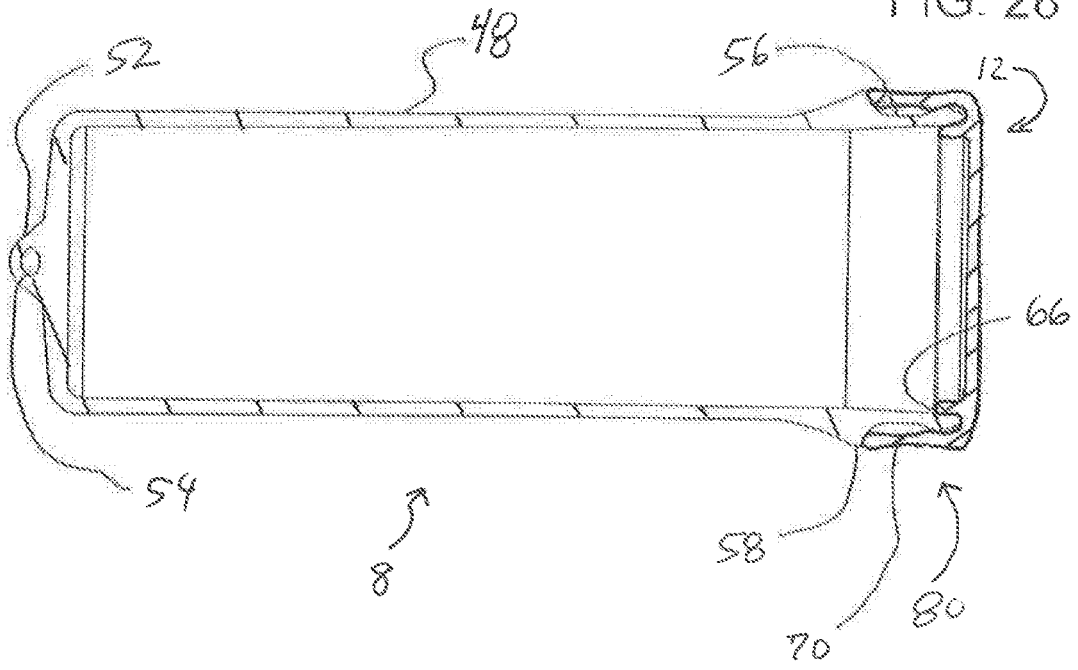
FIG. 28 is a diagrammatic cross sectional view of the waterproof dispensing of FIG. 24 being used as a storage container.

Turning now to FIGS. 27 and 28, a further modification of the present invention will now be described. As this embodiment is somewhat similar to the previously discussed embodiment, identical elements will be given identical reference numerals.

According to this variation, the present invention includes either the embodiment of FIGS. 1-17 or FIGS. 18-26 in combination (not shown) with a further second exterior housing 8. Identical to the first exterior housing 8, this second housing 8 can be utilized as a separate storage container to facilitate storage of a desired quantity of tobacco or other product to be consumed. The removable closure 80, discussed above, is typically utilized to seal the open end 12 of the exterior housing 8 in a waterproof or fluid tight manner. That is, the thickened annular section 60 of the exterior housing 8 is sandwiched between the radially inner annular sleeve 67 and the radially outermost annular sleeve 70 of the removable closure 80 to form an interference fit which forms a second contact of the waterproof seal between the removable closure 80 and the exterior housing 8 to form a waterproof seal therebetween.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

Wherefore, we claim:

1. A waterproof rolling paper dispensing apparatus comprising:

an inner cylinder being closed by a cylinder base wall at one end and open at an opposite end thereof, and the inner cylinder having an elongate slit extending from adjacent the closed end to at least adjacent the open opposite end of the inner cylinder;

an exterior housing being closed at one end by a housing base wall, and open at an opposite end thereof, the housing base wall of the exterior housing being spaced from the cylinder base wall of the inner cylinder, and the exterior housing defining an internal storage compartment for receiving, accommodating and storing the inner cylinder and a continuous roll of rolling paper, to be accommodated by the inner cylinder, within the internal storage compartment; and a single end cover releasably engaging and supporting the inner cylinder, and the single end cover being releasably engagable with the open opposite end of the exterior housing to form a waterproof seal for the inner cylinder and the waterproof rolling paper dispensing apparatus so that the inner cylinder and the continuous roll of rolling paper, to be accommodated by the inner cylinder, are completely surrounded by only the single end cover and the exterior housing, and when the exterior housing is removed from engagement with the single end cover to break the waterproof seal, the inner cylinder remains coupled to the single end cover but access to at least a leading end of the continuous roll of rolling paper, to be accommodated by the inner cylinder, is provided to a user; and wherein the inner cylinder, adjacent the open end thereof, has a thread, the single cover includes an annular intermediate sleeve and a radially outermost annular sleeve which both project substantially normal from an end wall of the single end cover, the single end cover has a mating thread which threadedly engages with the thread of the inner cylinder for releasably connecting the inner cylinder to the single end cover so that the inner cylinder remains coupled to and removable along with the single end cover, and when the open end of the exterior housing is received and sandwiched between the annular intermediate sleeve and the radially outermost annular sleeve, the waterproof seal is formed between the exterior housing and the single end cover.

2. The waterproof rolling paper dispensing apparatus according to claim 1, wherein an exterior surface of the inner cylinder has an external thread and the single end cover has a mating internal thread for releasably connecting the inner cylinder to the single end cover.

3. The waterproof rolling paper dispensing apparatus according to claim 1, wherein an inwardly facing surface of the base wall of the inner cylinder supports a first post and an inwardly facing surface of a base wall of the single end cover supports a second post and the first post and the second post engage with opposite ends of a tube supporting the continuous roll of rolling paper to facilitate dispensing of the rolling paper.

4. The waterproof rolling paper dispensing apparatus according to claim 1, wherein the exterior housing has a cylindrical sealing surface adjacent the open end thereof, the cylindrical sealing surface terminates at a shoulder which has a diameter which is larger than a diameter of the cylindrical sealing surface, and a thickness of a free perimeter edge of the cylindrical sealing surface increases to form a thickened annular section, and the thickness of the free perimeter edge is larger than a thickness of a remainder of the cylindrical sealing surface.

5. The waterproof rolling paper dispensing apparatus according to claim 4, wherein the single end cover supports a post which projects axially away from a base wall thereof, and the post is sized and shaped to be received within an end of a tube of the continuous roll of rolling paper to assist with both centering the tube and dispensing of a desired amount of the rolling paper;

the base wall of the single end cover supports a stop surface, and an innermost annular sleeve projects substantially normal from an end wall to the base wall of the single end cover; and the annular intermediate sleeve surrounds, but is spaced from, the innermost annular sleeve; and an inwardly facing surface of the intermediate sleeve carries an internal thread which is sized and shaped to matingly engage with an external thread provided adjacent the open end of the inner cylinder to assist with captively retaining the tube of the continuous roll of rolling paper therein.

6. The waterproof rolling paper dispensing apparatus according to claim 5, further comprising:

the radially outermost annular sleeve which is spaced from and surrounds the annular intermediate sleeve; and a radially inwardly facing surface of the outermost annular sleeve of the single end cover is provided with a plurality of inwardly facing protrusions located to engage with the thickened annular section of the exterior housing and form a snug, but releasable, fit with the cylindrical sealing surface of the exterior housing.

7. The waterproof rolling paper dispensing apparatus according to claim 1, wherein the exterior housing comprises a hollow cylindrical surface which is closed by the base wall, an exterior surface of a second end of the exterior housing has a nub with an aperture extending therethough, and the nub is sized and shaped to receive a coupling member which facilitates releasable attachment of the exterior housing to a desired object.

8. The waterproof rolling paper dispensing apparatus according to claim 6, wherein the single end cover is partially threadedly engaged with the inner cylinder, once the continuous roll of rolling paper is accommodated within the inner cylinder and the rolling paper passes though the elongate slit, to facilitate unwinding of the rolling paper from the tube, but when cutting a desired length of rolling paper from the tube is desired, the single end cover is fully threaded onto the inner cylinder so that the pair of stop surfaces directly abut against the opposed ends of the tube of rolling paper and thereby prevent further relative rotation of the tube with respect to the stop surfaces and the inner cylinder.

9. The waterproof rolling paper dispensing apparatus according to claim 1, wherein the single end cover has a storage compartment integrated therein to facilitate storage of a desired quantity of a consumable product;

a compartment cylindrical wall extends away from a base wall of the single end cover; and the compartment cylindrical wall and the base wall of the single end cover define the storage compartment.

10. The waterproof rolling paper dispensing apparatus according to claim 9, wherein the storage compartment has a cylindrical sealing surface adjacent the open end thereof; the cylindrical sealing surface terminates at a shoulder which has a diameter which is larger than a diameter of the cylindrical sealing surface of the storage compartment; and a thickness of a free perimeter edge of the cylindrical sealing surface of the storage compartment increases to form a thickened annular section, and the thickness of the free perimeter edge is larger than a thickness of a remainder of the cylindrical sealing surface of the storage compartment.

11. The waterproof rolling paper dispensing apparatus according to claim 10, wherein the radially outermost annular sleeve is spaced radially from and surrounds the annular intermediate sleeve; the outermost annular sleeve projects substantially normal from the end wall of the single end cover; a radially inwardly facing surface of the outermost annular sleeve of the removable closure is a smooth cylindrical surface which is provided with a plurality of inwardly facing protrusions; and each of the plurality of inwardly facing protrusions are located so as to engage with the thickened annular of the removable closure and thereby form a snug, but releasable, fit with the cylindrical sealing surface of the storage compartment.

12. The waterproof rolling paper dispensing apparatus according to claim 1, wherein the waterproof rolling paper dispensing apparatus further comprises at least one of a snuffer, which assists with extinguishing a burning product, and an alligator clip.

13. The waterproof rolling paper dispensing apparatus according to claim 1, wherein an exterior surface of the inner cylinder supporting supports a cutting edge which facilitates cutting of a desired length of rolling paper from the continuous roll of rolling paper to be accommodated within the inner cylinder.

14. The waterproof rolling paper dispensing apparatus according to claim 13, wherein the cutting edge extends parallel to the slit but is spaced from the slit so that, when a desired length of rolling paper is cut from the continuous roll of rolling paper, a sufficient length of rolling paper still remains and extends out through the slit for grasping by the user to facilitate cutting another desired length of rolling paper from the continuous roll of rolling paper.

15. The waterproof rolling paper dispensing apparatus according to claim 1, wherein the slit flares or tapers into a wider dimension, as the slit approaches the open end of the inner cylinder, to facilitate passing a leading end of the continuous roll of rolling paper therein.

16. The waterproof rolling paper dispensing apparatus according to claim 1, wherein the slit has a width which is sufficiently wide enough to permit the rolling paper to be passed therein.

17. The waterproof rolling paper dispensing apparatus according to claim 13, wherein the cutting edge is a serrated edge which comprises a plurality of spaced apart cutting teeth.

18. The waterproof rolling paper dispensing apparatus according to claim 1, wherein a cylindrical surface of the inner cylinder and the base wall of the inner cylinder define a snuffer cavity for accommodating a snuffer, and the snuffer is located within the snuffer cavity and has an aperture which is sized and shaped to assist with extinguishing a burning product.

19. A method of dispensing rolling paper from a waterproof rolling paper dispensing apparatus, the method comprising:

forming an inner cylinder which is closed at one end by a base wall of the inner cylinder and open at an opposite end thereof, forming an elongate slit in the inner cylinder so as to extend from adjacent the closed end to at least adjacent the open end of the inner cylinder, forming a thread in the inner cylinder adjacent the open end thereof, forming an exterior housing to be closed at one end by a base wall of the exterior housing and open at an opposite end thereof, spacing the base wall of the exterior housing from the base wall of the inner cylinder, defining an internal storage compartment in the exterior housing for receiving, accommodating and storing the inner cylinder and a continuous roll of rolling paper, to be accommodated by the inner cylinder, within the internal storage compartment, forming a mating thread on a single end cover, forming an annular intermediate sleeve and a radially outermost annular sleeve on the single end cover such that both the annular intermediate sleeve and the radially outermost annular sleeve project substantially normal from an end wall of the single end cover, engaging the thread of the inner cylinder with the mating thread of the single end cover so as to releasably connect the inner cylinder to the single end cover, releasably engaging the single end cover and the inner cylinder with the open end of the exterior housing by receiving and sandwiching the open end of the exterior housing between the annular intermediate sleeve and the radially outermost annular sleeve to form the waterproof seal to form a waterproof seal of the waterproof rolling paper dispensing apparatus, between the exterior housing and the single end cover, so that the inner cylinder and the continuous roll of rolling paper, to be accommodated by the inner cylinder, are completely surrounded by only the single end cover and the exterior housing, and when the single end cover is removed from engagement with the exterior housing to break the waterproof seal, the inner cylinder remains coupled to the single end cover and is removed with the single end cover but access to at least a leading end of the continuous roll of rolling paper, to be accommodated by the inner cylinder, is provided to a user.

20. A rolling paper dispensing apparatus comprising:

an inner cylinder being closed by a cylinder base wall at one end and open at an opposite end thereof, and the inner cylinder having an elongate slit extending from adjacent the closed end to at least adjacent the open opposite end of the inner cylinder;

an exterior housing being closed at one end by a housing base wall, and open at an opposite end thereof, the housing base wall of the exterior housing being spaced from the cylinder base wall of the inner cylinder, and the exterior housing defining an internal storage compartment for receiving, accommodating and storing the inner cylinder and a continuous roll of rolling paper, to be accommodated by the inner cylinder, within the internal storage compartment;

a single end cover releasably engaging and supporting the inner cylinder, and the single end cover being releasably engagable with the open opposite end of the exterior housing so that the inner cylinder and the continuous roll of rolling paper, to be accommodated by the inner cylinder, are completely surrounded by only the single end cover and the exterior housing, and when the exterior housing is removed from engagement with the single end cover, the inner cylinder remains coupled to the single end cover but access to at least a leading end of the continuous roll of rolling paper, to be accommodated by the inner cylinder, is provided to a user; and wherein the inner cylinder, adjacent the open end thereof, has an attachment end, the single cover includes an annular intermediate sleeve and a radially outermost annular sleeve which both project substantially normal from an end wall of the single end cover, the single end cover has a mating attachment feature which engages with the inner cylinder for releasably connecting the inner cylinder to the single end cover so that the inner cylinder normally remains coupled to and is removable from the exterior housing along with the single end cover, and when the open end of the exterior housing is received and sandwiched between the annular intermediate sleeve and the radially outermost annular sleeve such that a seal is formed between the open end of the exterior housing and the single end cover.

* * * * *